United States Patent [19]

van der Wyk

[11] Patent Number: 4,593,877

[45] Date of Patent: Jun. 10, 1986

[54] FLAG OR BANNER POLE SUPPORT BRACKET

[76] Inventor: Harry L. van der Wyk, 3885 Fairmeade Rd., Pasadena, Calif. 91107

[21] Appl. No.: 539,811

[22] Filed: Oct. 7, 1983

[51] Int. Cl.[4] ..... A01K 97/10

[52] U.S. Cl. ..... 248/512; 248/535; 248/538; 248/541; 248/231

[58] Field of Search ..... 248/511, 512, 513, 518–520, 248/523, 534–535, 538, 540, 541, 207, 219.3, 231; 403/389, 391

[56] References Cited

U.S. PATENT DOCUMENTS

| | | | |
|---|---|---|---|
| 881,006 | 3/1908 | Kline | 248/519 |
| 1,103,257 | 7/1914 | Bollinger | 248/512 |
| 1,113,781 | 10/1914 | Griffin | 248/231 |
| 1,551,719 | 9/1925 | Williams | 248/512 |
| 1,575,614 | 3/1926 | Blaw | 248/512 |
| 1,893,585 | 1/1933 | Hogan | 248/512 |
| 2,448,752 | 9/1948 | Wagner | 248/512 |
| 2,460,568 | 2/1949 | Buehner | 248/535 |
| 2,462,442 | 2/1949 | Wallace | 248/541 |
| 3,012,750 | 12/1961 | Schermerhorn | 248/231 |
| 3,844,459 | 10/1974 | Chambers . | |
| 3,905,324 | 9/1975 | English | 248/512 |
| 3,920,207 | 11/1975 | Adamaitis | 248/538 |
| 4,366,907 | 1/1983 | Toy | 248/512 |

FOREIGN PATENT DOCUMENTS

| | | | |
|---|---|---|---|
| 2435670 | 2/1975 | Fed. Rep. of Germany | 403/391 |
| 733847 | 7/1955 | United Kingdom | 403/391 |

*Primary Examiner*—J. Franklin Foss
*Assistant Examiner*—Robert A. Olson
*Attorney, Agent, or Firm*—John E. Wagner

[57] ABSTRACT

A flag pole bracket is disclosed for attachment to a flat surface or a cylindrical pole. The bracket includes a body with a plurality of openings therein to support flag poles at different angles relative to each other. The bracket also includes screw holes for mounting to a flat surface, and transverse strap receiving openings to receive straps mounted around a cylindrical pole.

12 Claims, 15 Drawing Figures

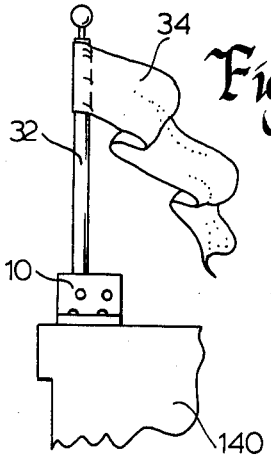
Fig. 7
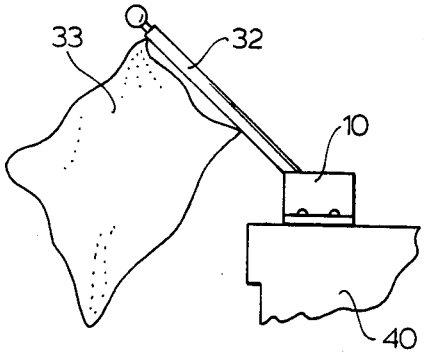
Fig. 8
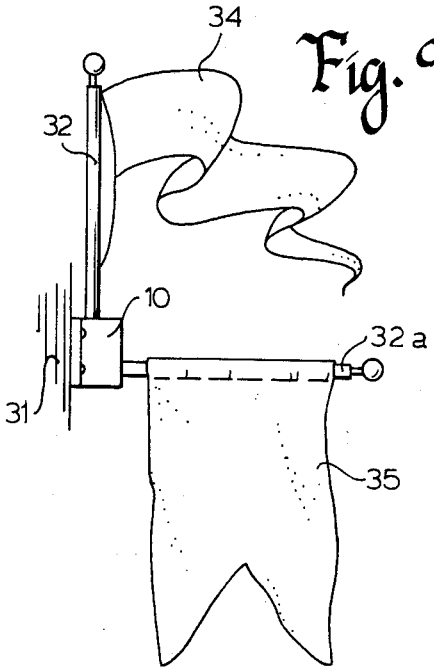
Fig. 9
Fig. 10
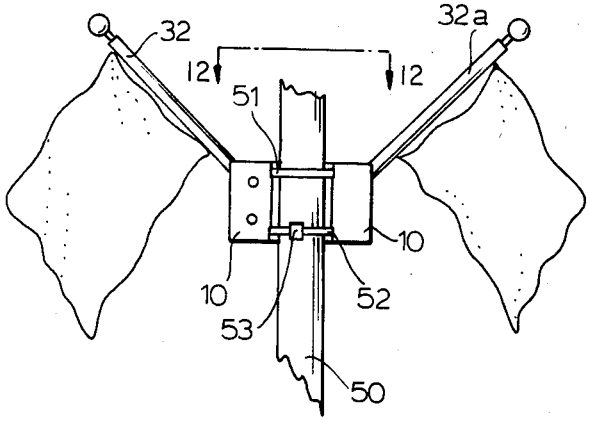

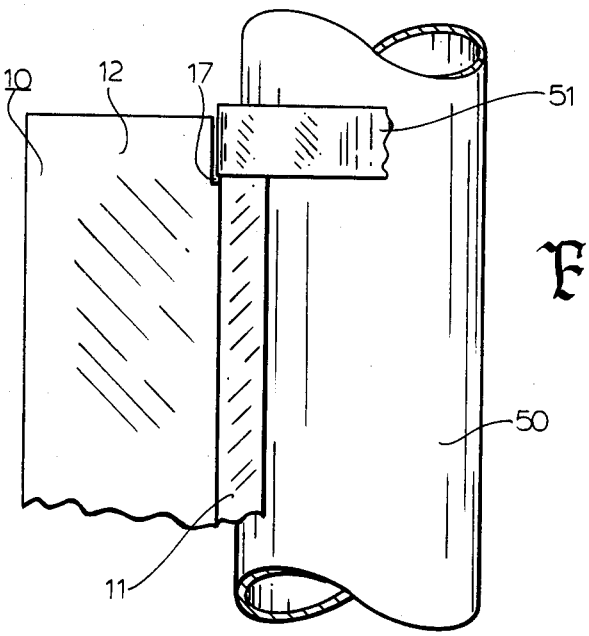
Fig. 11
Fig. 12
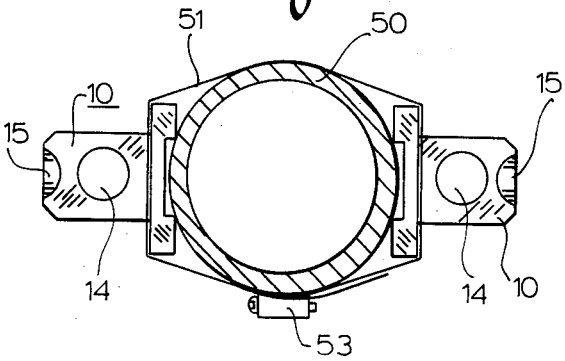
Fig. 13
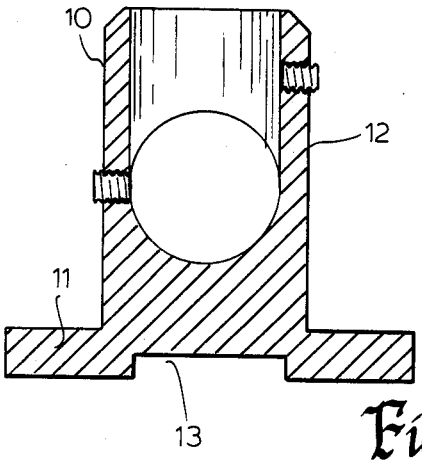
Fig. 14
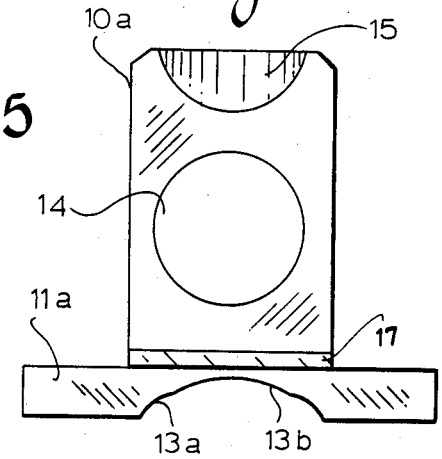
Fig. 15
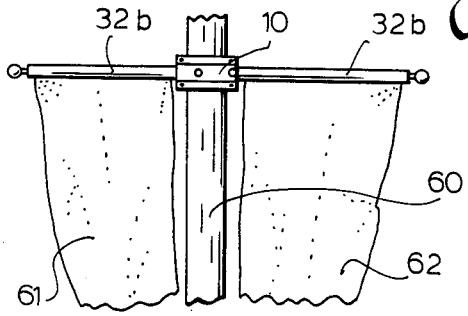

FLAG OR BANNER POLE SUPPORT BRACKET

BACKGROUND OF THE INVENTION

The bracket for holding flag or banner poles has been the stepchild of the flag standard field. After a flag or banner is designed, it needs some form of support. An attractive pole is selected of suitable size and strength and to many, the project is completed. The mount or support for the pole is considered incidental, particularly if the flag or banner is small, e.g. under six feet in length.

The result has been that most supports for flag or banner poles are merely weighted bases or pipes with central holes for ground use or pipe sections welded to base plates. Sometimes wall brackets are cast of aluminum, bronze or iron. Brackets of this type usually mount the flag or banner pole at a fixed angle and are notable in their functional effectiveness if not beauty. Some brackets are adjustable but these often lack sufficient strength or are unduly complicated.

BRIEF DESCRIPTION OF THE INVENTION

Faced with this state of the art and particularly the lack of attention to the design of pole brackets, I undertook to carefully analyze the true needs and objectives of pole brackets. I also studied the available materials to determine the most effective and attractive material to use for a pole bracket.

It was apparent to me that the person wanting to display a flag or banner does not want to be limited to one and one only way of displaying said flag or banner which is bracket mounted. Likewise, the surface and orientation of the structure upon which the bracket is to be mounted may not give itself to the available brackets. I therefore sought to design a bracket which may be mounted on horizontal, vertical or inclined flat surfaces. I also sought a bracket which could be mounted on curved or cylindrical surfaces by either mounting screws or straps. I moreover wanted a bracket which itself is attractive, easy to mount and use, flexible as to the mode of displaying the flag or banner and low in cost.

Each of these objectives have been met by my new design of a pole bracket which comprises, generally, an inverted T shaped elongated member, preferably of extruded aluminum. The head of the T which acts as the mounting base includes mounting holes for attachment to flat surfaces regardless of their orientation.

The upstanding part of the leg of the T includes a longitudinal hole which extends through the body from one end to the other. A second hole extends normal to the first hole from the bottom of the base of the T to but not through the head of the T or mounting surface of the bracket. A third hole extends from the base of the T at an angle with respect to the mounting surface, e.g. 45 degrees. The three holes intersect in the body of the T but sufficient material remains in the bracket to support a pole in any of the openings.

Three locking means, for example, set screws, threadably engage the body and are drivable into at least one of the holes to secure poles in place. The locking means are located so that they are hardly noticable and do not detract from the appearance of the bracket.

The mounting surface of the bracket, namely the head of the T, includes a recess which allows the bracket to conform to a curved cylindrical support structure such as a city light standard.

Opposite ends of the bracket each include local grooves between the head and the base of the T extending trasverse to the length of the bracket. These grooves allow a strap to encircle the mounting portion of the bracket for strap mounting without interfering with the display of flags or banner on the bracket.

BRIEF DESCRIPTION OF THE DRAWING

This invention may be more clearly understood from the following detailed description and by reference to the drawing in which:

FIG. 7 is a side elevational view of a mounting bracket of this invention mounted on a horizontal surface mounting a vertical pole;

FIG. 8 is a side elevational view of the mounting bracket of FIG. 7 mounting a pole at an inclined angle;

FIG. 9 is a side elevational view of the mounting bracket of FIG. 7 mounting a pair of poles, one vertically and one horizontally;

FIG. 10 is a side elevational view of a pair of brackets in accordance with this invention mounted on opposite sides of a pole by straps;

FIG. 11 is an enlarged fragmentary elevational view of one of the brackets of FIG. 10;

FIG. 12 is a horizontal sectional view of the pole and brackets of FIG. 10, taken along line 12—12 of FIG. 10;

FIG. 13 is a vertical sectional view of the bracket of FIG. 1 taken along line 13—13 of FIG. 1;

FIG. 14 is an end view of an alternate embodiment of this invention; and

FIG. 15 is a side elevational view of another alternate application of this invention mounting a pair of banners side by side.

DETAILED DESCRIPTION OF THE INVENTION

Figure 1:
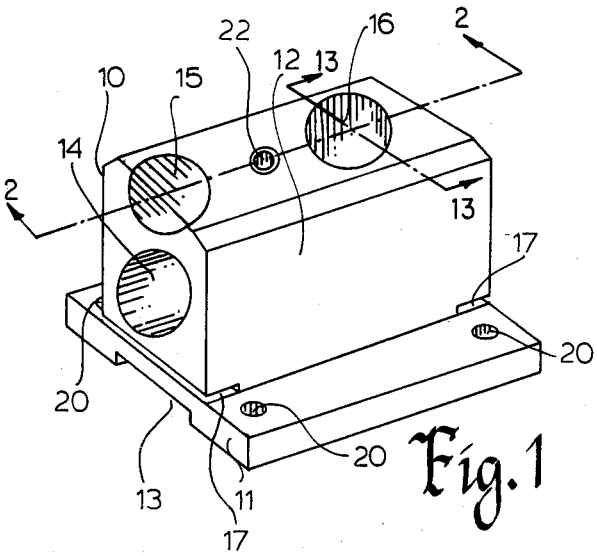
FIG. 1 is a perspective view of a pole mounting bracket in accordance with this invention.
Figure 2:
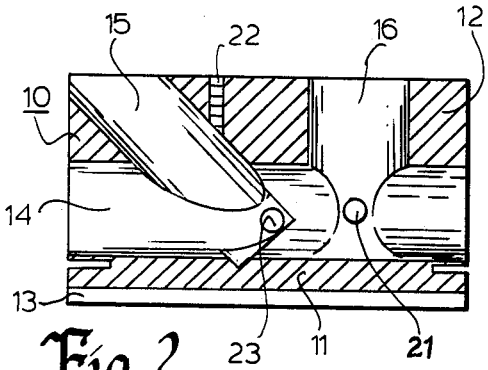
FIG. 2 is a longitudinal vertical sectional view thereof taken along line 2—2 of FIG. 1.

Now referring to FIGS. 1 and 2, the basic form of this invention may be seen. It comprises a bracket, generally designated 10 in the shape of an inverted T with the head 11 of the T constituting the mounting surface for the bracket 10. Extending upward from the base 11 is the body 12 of the bracket 10 being, in one illustrative embodiment, in the order of 1¼" in thickness and approximately 2" high. The overall height of the bracket being in the order of 2 ⅜" high. The base 11 includes an undercut 13, the purpose of which will be described below. The bracket 10 may be of any length as desired, and the longer the bracket 10, the more poles it will support.

For purposes of explanation of this invention, the bracket 10 is illustrated as approximately 3" long and includes three openings 14, 15 and 16 for holding flag or banner poles. The opening 14 is longitudinal and extends totally through the body portion 12. The opening 15 is at an inclined angle with respect to the base, the preferred angle being 45 degrees. The opening 16 extends into the body 12 normal (90 degrees) with respect to the base 11 and the hole 14. These three holes 14, 15 and 16 allow the mounting of a pole in four ways, 1. extending out of the left end of opening 14;
2. extending out of the right end of opening 14;
3. extending at an angle out of opening 15; and
4. extending vertically, in FIG. 1, out of opening 16.

A plurality of mounting holes 20 are located at the four corners of the base 11 to secure the bracket 10 to a support structure. One of three set screws 22 appears in FIG. 1, positioned to lock a pole in the angular opening 15. A pair of additional set screws, 21 and 23, appearing in FIG. 2, secure poles in openings 16 and 14, respectively.

FIG. 2 illustrates that the body 11 is solid metal except for the openings 14, 15 and 16. Although the openings 14, 15 and 16 intersect with at least one other opening, sufficient material remains in the bracket 10 to provide adequate strength for holding a pole of as long as eight feet in length and a flag or banner of up to twenty feet in length.

Figure 3:
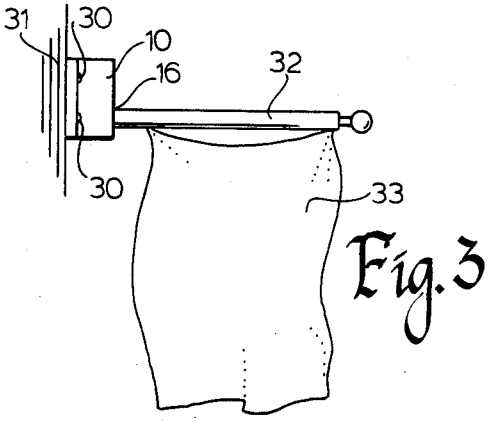
FIG. 3 is a side elevational view of a mounting bracket in accordance with this invention mounted on a vertical wall with a horizontal pole.
Figure 4:
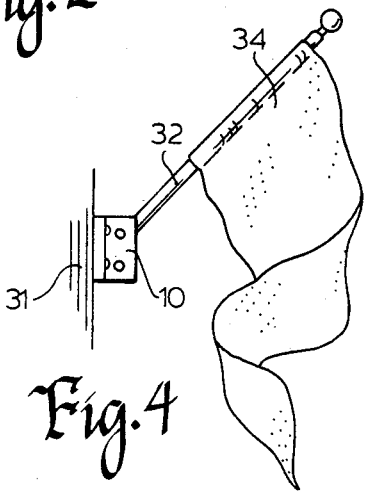
FIG. 4 is a side elevational view of the bracket of FIG. 3 mounting a pole at an inclined angle.
Figure 5:
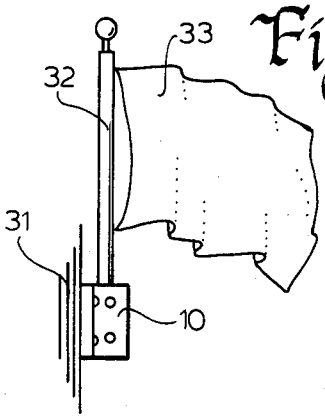
FIG. 5 is a side elevational view of the bracket of FIG. 3 mounting a pole vertically.

The basic use of this invention is illustrated in FIG. 3 in which bracket 10 is secured as by screws 30 to a wall or other supporting surface 31. A single pole 32 supporting a flag 33 is in slip fit relationship in opening 16 and secured in place by setscrew 21 (of FIG. 2). The mounting of FIG. 3 may be either permanent or temporary. In most cases the bracket 10 is mounted permanently and the pole 32 is either permanently or temporarily in place. The pole 32 may be moved to opening 15, of FIGS. 1 and 2 presenting the appearance of FIG. 4, in this case, supporting a banner 34. The same bracket 10 of FIGS. 1 through 4, without change, supports pole 32 vertically in opening 14 as illustrated in FIG. 5.

Figure 6:
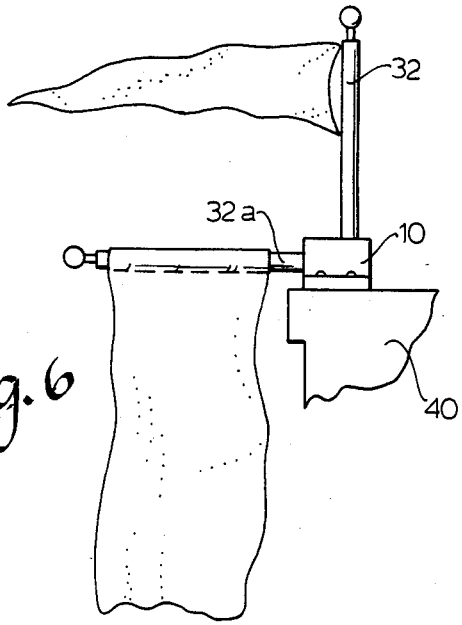
FIG. 6 is a side elevational view of the mounting bracket of FIG. 3 mounting two poles, one horizontally and one vertically.

The bracket 10 of this invention may be mounted on a horizontal surface such as the cornice of a building 40 as illustrated in FIG. 6. In this case, the bracket 10 is located near the corner of the cornice and supports two poles 32 and **32*a* with pole 32 extending vertically in opening 16 and pole 32*a* extending horizontally in opening 14 of FIGS. 1 and 2. The mounting of two or more flags or banners from a single mounting bracket changes the appearance of the area dramatically and all done without any change in mounting brackets. The contrast of double mounting of poles as illustrated in FIG. 6 is more apparent when compared to FIGS. 7 and 8 showing horizontally mounted bracket 10** each carrying one flag or banner.

Dual mounting of a pair of poles 32 and **32*a* on a vertically mounted bracket 10 is illustrated in FIG. 9**.

In each of these cases, the bracket 10 may be left permanently in place and the pole or poles and flags or banners removed. The bracket 10 to the extent that it is visible presents an attractive anodized aluminum surface in any of a number of colors, if desired. It therefore does not detract from the appearance of the support structure when not is use.

A common requirement for municipal flag or banner poles is that they be mounted from street lighting standards and often more than one flag or banner from a single standard. The standards are often tapered and of various diameters.

The bracket of this invention is easily adapted to mounting on round or tapered standards as is illustrated in FIG. 10 through 12. In that figure, a pair of identical brackets 10 are mounted on standard 50 by a pair of straps 51 and 52 which encircle the standard 50 and extend through the slots 17 of FIG. 1. The straps 51 and 52, one at the top region of the brackets 10 and the second at the bottom, when tensioned, as by a screw tensioner 53, for example, better seen in FIG. 12, securely holds both brackets 10 on the standard 50. This form of attachment is accomplished merely by the presence of the slots 17. Of course, self-tapping or other screws may be used as well to mount the brackets on larger cylindrical standards but the strap mounting is preferred because of its simplicity, low cost, rapidity of installation and since it does not mar the standard. Using the straps 51 and 52, as illustrated in FIGS. 11 and 12, the straps need only encircle the standard 50 loosely, the bases 11 of the brackets 10 slipped within the straps and the straps 51 and 52 each slipped into their respective slot 17. Friction of the strap within the slots 17 is sufficient to hold the brackets loosely until properly positioned. Then, tightening the screw fastener 53 securely attaches the brackets 10, two or more at once, to the standard 50. Although two brackets 10 are illustrated as mounted on standard 50 of FIG. 10, it is apparent that four or more brackets may be positioned about the standard 50 depending upon its diameter, all with a single pair of mounting straps 51 and 52.

The slot 13 on the underside of the head portion 11 of brackets 10 allows the standard 50 to engage the bracket at two spaced points rather than a single tangency as would be the case if the head 11 were totally flat. This feature provides a reliable mounting upon cylindrical or tapered standards. In case even more surface contact with the standard is desired, the modified form of head **11*a* is illustrated in FIG. 14. There, the recess 13 has in fact, not one but two radii of curvature 13*a* and 13*b*** which match the shape of cylindrical or tapered standards of various diameters.

Alternate side positioning of the setscrews 21 used to secure the poles in the respective openings is best illustrated in FIG. 13. These setscrews are located in relatively thick portions of the body 12 of the bracket 10 and each engage the sidewall of the pole in its receiving hole. In a typical example the poles are aluminum of 1 $\frac{1}{8}$" diameter.

Now referring to FIG. 15, an alternate form of mounting is illustrated. In this case, bracket 10 is mounted horizontally on a rectangular column 60 by mounting screws. Extending out of both ends of opening 14 are a pair, or preferably, a single longer pole **32*b* on opposite sides of the vertical standard 60. A pair of banners 61 and 62 are supported on the pole 32*b* on opposite sides of the standard 60** and are drawn together at the bottom in an attractive pull down heraldic configuration. This figure again illustrates that the bracket of this invention has additional applications while maintaining its attractive yet unobtrusive presence.

One of the great advantages of this invention to the manufacturer is the fact that even with the broad variety of ways this bracket may be used, as illustrated in the drawings, it basically is a single extrusion of a material such as aluminum. In the form here illustrated, the aluminum body has great strength and may be given attractive surface treatments by anodizing. It is still low in cost since it is basically extruded in continuous lengths, cut to whatever length is desired. Three pole mounting holes are drilled in the extrusion (or opening 14 may be formed in the extrusion step if desired). The drilling of mounting holes, drilling and tapping of set-screw holes and milling of slots 17 complete the manufacturing operation save for deburring and surface treatment. The net result is that a far superior, more versatile and yet inexpensive flag or banner pole mounting bracket has been produced.

The foregoing embodiments of this invention are merely illustrative thereof and are not to be considered as limiting. Rather, this invention is defined by the following claims including their equivalents.

I claim:

1. A mounting bracket for mounting on a support surface and for holding one or more supported objects such as a cylindrical pole in a variety of positions comprising:

and elongated body including a base portion and an upstanding body portion;

said base portion and upstanding body portion defining a generally inverted T shape;

said base portion for mounting said bracket on a supporting surface;

said upstanding portion including a plurality of intersecting openings therein at different relative angles with respect to said base portion;

said openings being dimensioned to receive supported objects such as cylindrical poles therein with a supported object which may be mounted by said bracket positioned by the wells defining one opening and extendable into at least part of the remaining openings of said body whereby common object supporting usage of the volume making up the body of the mounting bracket results;

at least one of said openings extending generally parallel to the length of said elongated body;

means for securing such supported objects within respective openings, said base portion including mounting holes therein for directly mounting said base portion on a support surface and transverse strap receiving openings therethrough to allow strap mounting thereof.

2. A mounting bracket in accordance with claim 1 wherein said elongated body is a solid block of metal except for said openings and said cylindrical pole receiving openings intersect within said solid block of metal and extend at least partially through at least one of the other of said cylindrical pole receiving openings.

3. A mounting bracket in accordance with claim 2 wherein said solid block of metal is extruded aluminum.

4. A mounting bracket in accordance with claim 1 wherein one of said openings extends completely through said body in the direction of its elongation whereby one supported object may extend out of opposite ends of said bracket and support flags or banners at opposite ends of said bracket.

5. A mounting bracket in accordance with claim 1 wherein one of said openings extends normal to the mounting surface of said base portion, intersects and extends into at least one of said other openings, whereby said upstanding portion provides sufficient depth to support an object in said normal opening and whereby a flag or banner may be supported from an object extending normal to the length of said bracket.

6. A mounting bracket in accordance with claim 1 wherein said body defines transverse strap receiving openings extending transverse to the direction of elongation of said body in the region of said upstanding body portion;

and including strap fastening means for mounting said bracket;

whereby said mounting bracket is mounted by said strap fastening means extending through said transverse strap receiving openings with said strap fastening means in broad area contact with said body generally at the base of said inverted T.

7. The combination in accordance with claim 6 including a pair of such transverse strap receiving openings at opposite ends of said elongated body.

8. A mounting bracket in accordance with claim 7 wherein said transverse strap receiving openings are exposed at the ends of said elongated body;

elongated strap fastening means dimensioned to encircle a support surface and to fit in said transverse strap receiving openings;

whereby said strap fastening means may be inserted within said transverse strap receiving openings from the ends of said body and said transverse strap receiving openings include at least one generally planar surface for broad area contact between the body and said strap fastening means passing through said transverse strap receiving openings.

9. A mounting bracket in accordance with claim 1 wherein said base portion includes a recess therein extending the length of said base portion whereby said base portion may be secured to a cylindrical or convex surface with the base portion having at least a pair of spaced regions of contact rather than a single line of tangency.

10. A mounting bracket in accordance with claim 9 wherein said base portion includes a pair of transverse strap receiving openings therethrough, and said transverse strap receiving openings receive said strap means adapted to encircle a cylindrical or convex surface and secure said mounting bracket to such surface.

11. A mounting bracket in accordance with claim 10 wherein said transverse strap receiving openings are located at the opposite end regions of said body and each transverse strap receiving opening is open at the end of said body and extends through the sides of said body whereby said strap means is adapted to loosely encircle a cylindrical or convex surface and is inserted in the slots in said body from the respective ends thereof and the strap means are adapted to hold said mounting bracket securely against the cylindrical or convex surface.

12. A mounting bracket in accordance with claim 9 wherein said recess comprises a pair of surfaces of different radii of curvature whereby said bracket may be secured to cylindrical or curved surfaces of different diameters with greater surface contact than in the case of a rectangular recess.

* * * * *